US008848962B2

(12) United States Patent
Akino

(10) Patent No.: US 8,848,962 B2
(45) Date of Patent: Sep. 30, 2014

(54) UNIDIRECTIVE CONDENSER MICROPHONE UNIT AND CONDENSER MICROPHONE

(75) Inventor: Hiroshi Akino, Kanagawa (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 226 days.

(21) Appl. No.: 13/419,894

(22) Filed: Mar. 14, 2012

(65) Prior Publication Data

US 2012/0237072 A1 Sep. 20, 2012

(30) Foreign Application Priority Data

Mar. 16, 2011 (JP) ..... 2011-057455

(51) Int. Cl.
*H04R 19/04* (2006.01)

(52) U.S. Cl.
CPC ..... *H04R 19/04* (2013.01)
USPC ..... 381/356; 381/92

(58) Field of Classification Search
USPC ..... 381/356, 174
See application file for complete search history.

(56) References Cited

U.S. PATENT DOCUMENTS

| | | | | |
|---|---|---|---|---|
| 2004/0005070 | A1* | 1/2004 | Kanda et al. | 381/369 |
| 2006/0104468 | A1* | 5/2006 | Yamamoto et al. | 381/361 |
| 2008/0002837 | A1* | 1/2008 | Akino | 381/92 |
| 2009/0090190 | A1* | 4/2009 | Ueya | 73/724 |
| 2009/0161894 | A1* | 6/2009 | Kimura | 381/174 |

FOREIGN PATENT DOCUMENTS

| | | | |
|---|---|---|---|
| JP | 2007-116225 | A | 5/2007 |
| JP | 2008-72271 | A | 3/2008 |

* cited by examiner

*Primary Examiner* — Duc Nguyen
*Assistant Examiner* — Phan Le
(74) *Attorney, Agent, or Firm* — Whitham Curtis Christofferson & Cook, PC

(57) ABSTRACT

A unidirective condenser microphone unit includes a diaphragm; a fixed electrode facing the diaphragm with a gap and defining a capacitor together with the diaphragm; an insulating spacer disposed adjacent to the rear surface of the fixed electrode and supporting the fixed electrode; an acoustic resistor disposed in an air chamber defined by the front surface of the insulating spacer and the fixed electrode; a unit case, a front acoustic terminal; and a rear acoustic terminal. The insulating spacer has a protrusion projecting toward the fixed electrode with a gap, and the protrusion is fixed to the surface of the fixed electrode with fixing material.

14 Claims, 6 Drawing Sheets

RELATED ART

UNIDIRECTIVE CONDENSER MICROPHONE UNIT AND CONDENSER MICROPHONE

TECHNICAL FIELD

The present invention relates to a unidirective condenser microphone unit that exhibits reduced vibration of an insulating spacer and has stable frequency response even with low-profile components in the unit and a condenser microphone including the unit.

TECHNICAL FIELD

Background Art

As described in Japanese Patent Laid-Open Publication No. 2008-072271, a microphone unit in a unidirective condenser microphone includes two acoustic terminals as a front acoustic terminal and a rear acoustic terminal and drives a diaphragm by the difference in acoustic pressure between the acoustic terminals to convert the vibration of the diaphragm into electric signals. The unidirective condenser microphone unit includes the diaphragm having a front surface functioning as the front acoustic terminal and a rear surface functioning as the rear acoustic terminal.

FIG. 5 illustrates a typical known unidirective condenser microphone unit. This microphone is a typical unidirective condenser microphone unit including two diaphragms, i.e., a front diaphragm and a rear diaphragm.

In FIG. 5, the unidirective condenser microphone unit 1 includes an insulating spacer 6 dividing the inside of a unit case 15 into two areas that accommodate a front microphone element 20 in the front (left in FIG. 5) and a rear microphone element 30 in the rear (right in FIG. 5), respectively, the insulating spacer 6 being disposed between the front and rear microphone elements 20 and 30.

The element 20 includes a front acoustic terminal 2 on the unit case 15, a front diaphragm 11 in the unit case 15, a front fixed electrode 8 facing the front diaphragm 11 with a predetermined gap, a front air chamber 18 in the rear of the front fixed electrode 8, and a front acoustic resistance 5 in the front air chamber 18.

The element 30 includes a rear acoustic terminal 3 on the unit case 15, a rear diaphragm 12 in the unit case 15, a rear fixed electrode 9 facing the rear diaphragm 12 with a predetermined gap, a rear air chamber 19 in the front of the rear fixed electrode 9, and a rear acoustic resistance 4 in the rear air chamber 19.

The insulating spacer 6 includes an acoustic hole 7 such that the front air chamber 18 communicates with the rear air chamber 19. Although FIG. 5 depicts one acoustic hole 7, the unit includes multiple acoustic holes 7 in reality.

Sound waves from the rear acoustic terminal 3 propagate through the rear acoustic resistance 4 and the acoustic hole 7 in the insulating spacer 6 to the front air chamber 18 in the rear of the front fixed electrode 8 and then urge the rear of the front diaphragm 11 to provide unidirectivity in the front diaphragm 11. The front air chamber 18 in the rear of the front fixed electrode 8 provides omnidirective driving force, and sound waves from the rear acoustic terminal 3 provide bidirective driving force. A bidirective driving force equal to the omnidirective driving force provides sound collection characteristics having cardioid unidirectivity. The principle of the unidirectivity in the rear diaphragm 12 is the same as that of the front diaphragm 11 except for the reversal geometrical configuration between the front and the rear of the relevant components and thus the duplicated description is omitted.

SUMMARY OF INVENTION

Technical Problem

A condenser microphone generally has high sensitivity with an increase in the effective area of a diaphragm. An increase in the effective area of the diaphragm tends to expand a gap between a front acoustic terminal and a rear acoustic terminal (hereinafter referred to as "acoustic interterminal distance"). If the acoustic interterminal distance is sufficiently short in comparison with the wavelength of sound waves, a longer acoustic interterminal distance increases bidirective driving force with an increase in the frequency of the sound waves. If the increasing half-width of the sound waves however reaches the acoustic interterminal distance, driving force by the difference in acoustic pressure is lost. The acoustic interterminal distance therefore needs to be short in order to provide driving force by the difference in acoustic pressure up to a high frequency region.

The thickness of components in a condenser microphone unit is generally designed to be reduced to decrease the thickness of the microphone unit for a short acoustic interterminal distance.

In the case of using a condenser microphone unit having a large diameter and a thin insulating spacer defining an air chamber in the rear of a fixed electrode, a partition wall of the insulating spacer is vibrated by sound waves, which vibration may significantly disturb frequency response. FIG. 6 illustrates frequency response disturbed by vibration of the partition wall of the insulating spacer in response to sound waves in the typical known unidirective condenser microphone unit 1 in FIG. 5. The frequency response in a frequency range "A" in FIG. 6 increases and decreases significantly. Such disturbed frequency response may cause problems such as low sound quality or howling.

It is an object of the present invention, in view of the above problems, to provide a unidirective condenser microphone unit that exhibits reduced vibration of an insulating spacer and has stable frequency response even with low-profile components in the unit and a condenser microphone including the unit.

Solution to Problem

In accordance with an embodiment of the present invention, a unidirective condenser microphone unit includes: a diaphragm; a fixed electrode facing the diaphragm with a gap and defining a capacitor together with the diaphragm; an insulating spacer disposed adjacent to the rear surface of the fixed electrode and supporting the fixed electrode; an acoustic resistor disposed in an air chamber defined by the front surface of the insulating spacer and the fixed electrode; a unit case containing the diaphragm, the fixed electrode, the insulating spacer, and the acoustic resistor; and a front acoustic terminal and a rear acoustic terminal. The insulating spacer has a protrusion projecting toward the fixed electrode with a gap, and the protrusion is fixed to the surface of the fixed electrode with fixing material. In accordance with another embodiment of the present invention, the condenser microphone unit is included in a condenser microphone.

DESCRIPTION OF EMBODIMENTS

Figure 5:
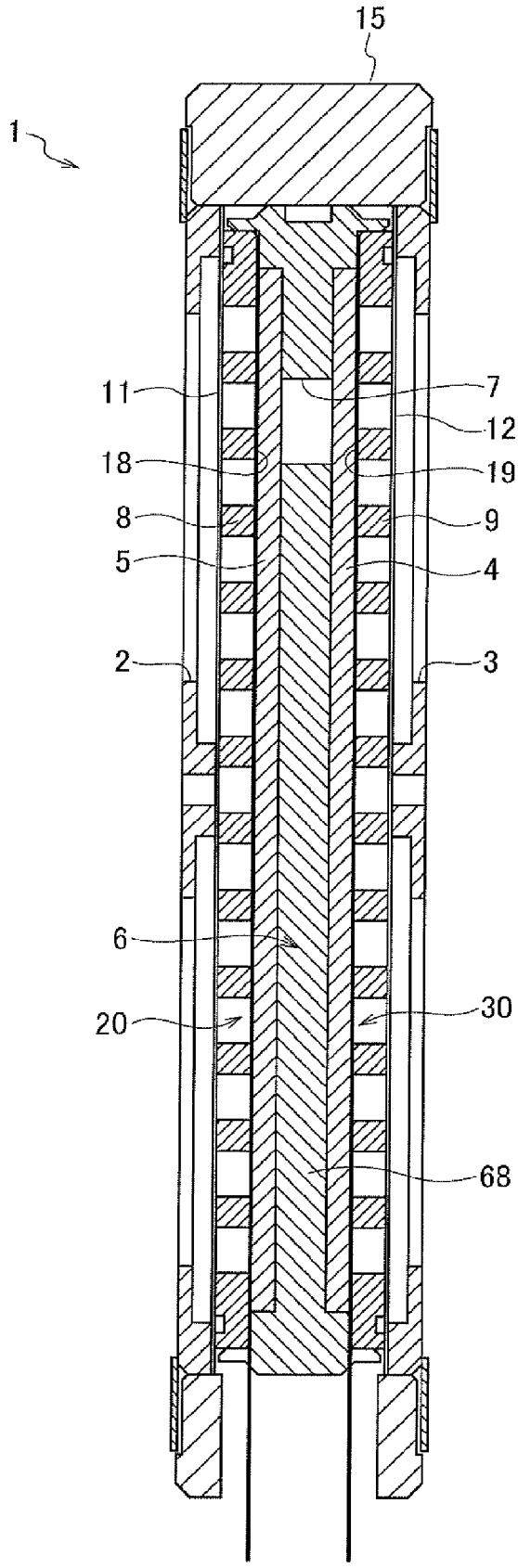
FIG. 5 is a cross-sectional view illustrating a typical known unidirective condenser microphone unit.

A unidirective condenser microphone unit in an embodiment of the present invention will now be described with reference to FIGS. 1 to 3. Identical components with those of the typical known unit in FIG. 5 are designated with identical reference numerals.

Figure 1:
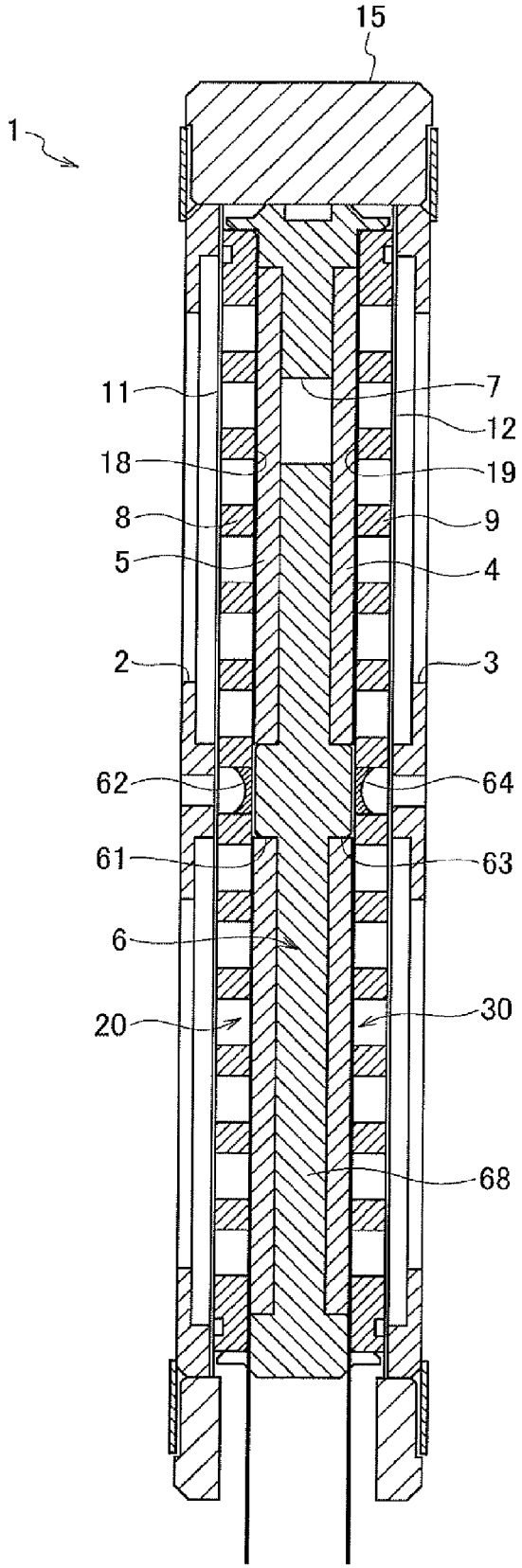
FIG. 1 is a cross-sectional view illustrating a unidirective condenser microphone unit in accordance with an embodiment of the present invention.

As shown in FIG. 1, the microphone unit 1 in the embodiment includes an insulating spacer 6 dividing the inside of a unit case 15 into two areas that accommodate a front microphone element 20 in the front (left in FIG. 1) and a rear microphone element 30 in the rear (right in FIG. 1), respectively, the insulating spacer 6 being disposed between the front and rear microphone elements 20 and 30. In the embodiment, two elements, the front and rear microphone elements 20 and 30 are provided. Alternatively, in the present invention, any number of elements, for example, only one element may be provided.

The element 20 includes a front acoustic terminal 2 on the unit case 15, a front diaphragm 11 in the unit case 15, a front fixed electrode 8 facing the front diaphragm 11 with a predetermined gap, and a front acoustic resistance 5.

The element 30 includes a rear acoustic terminal 3 on the unit case 15, a rear diaphragm 12 in the unit case 15, a rear fixed electrode 9 facing the rear diaphragm 12 with a predetermined gap, and a rear acoustic resistance 4.

Figure 2A:
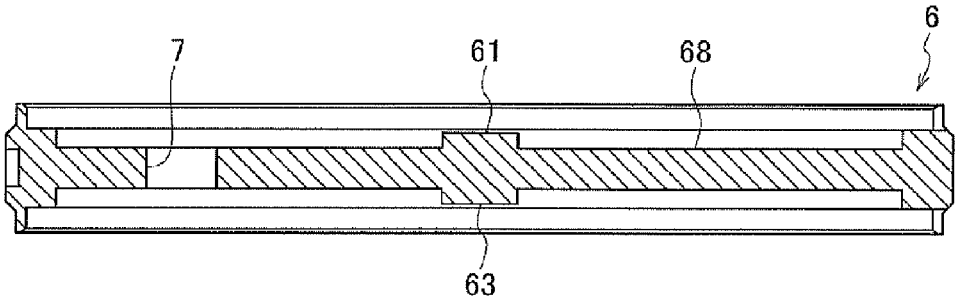
FIGS. 2A and 2B are a cross-sectional view and a plan view, both illustrating an insulating spacer used in the embodiment.
Figure 2B:
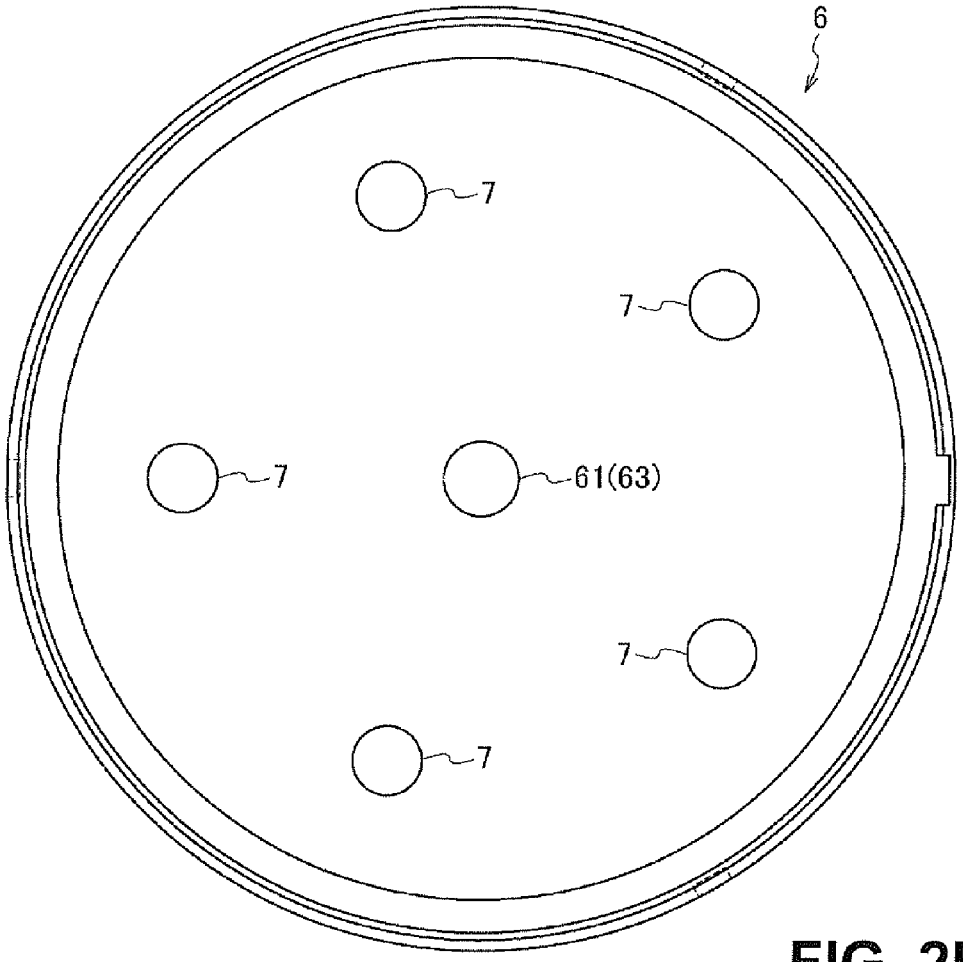
Figure 3:
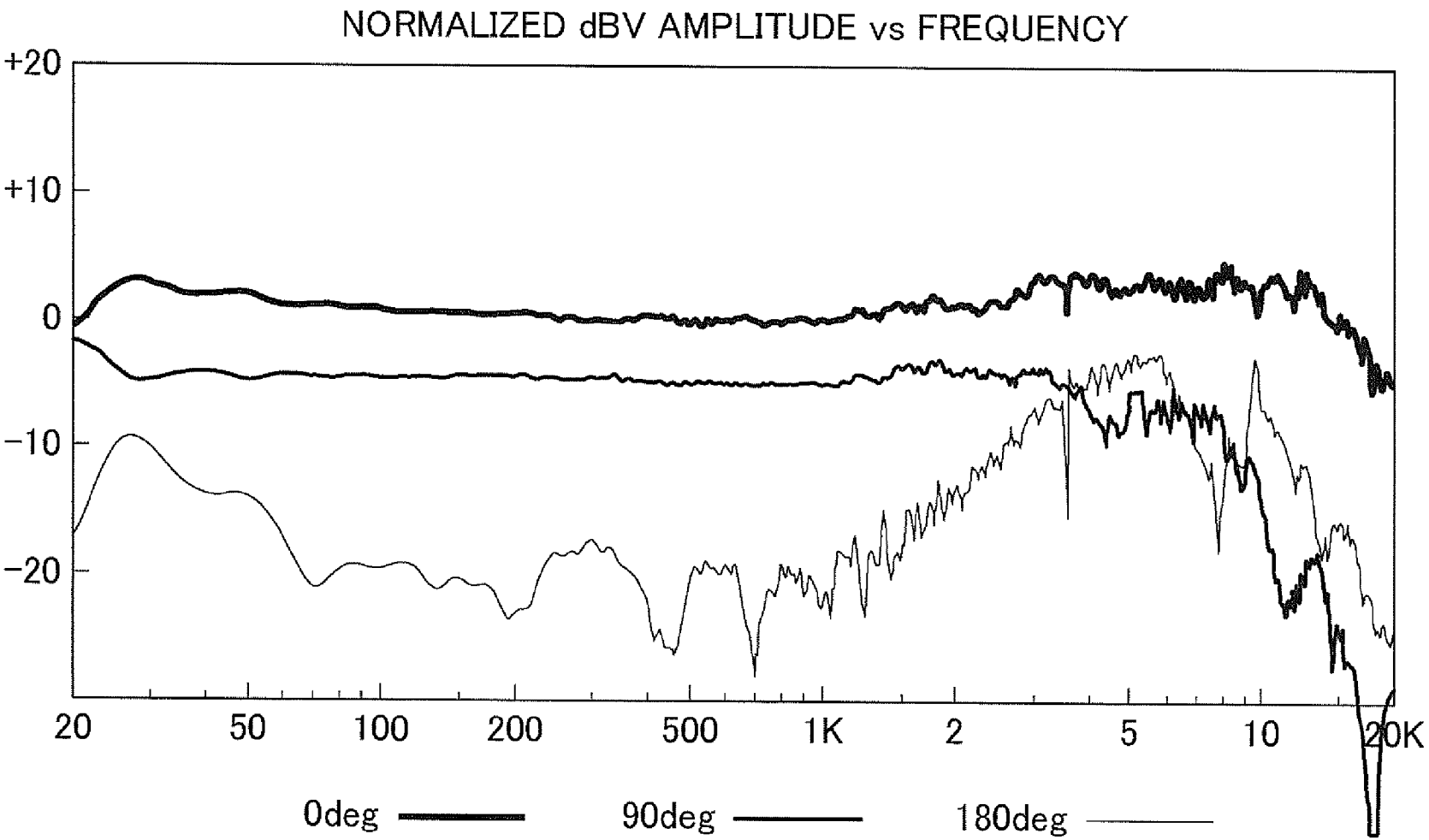
FIG. 3 is a graph illustrating the frequency response in the embodiment.
Figure 4A:
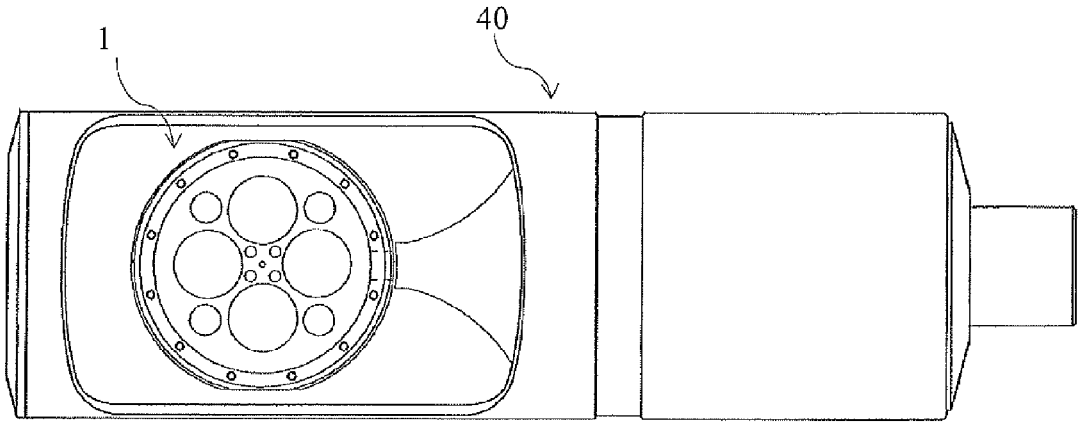
FIGS. 4A and 4B are a front view and a side view, both illustrating the unidirectional condenser microphone in the embodiment.
Figure 4B:
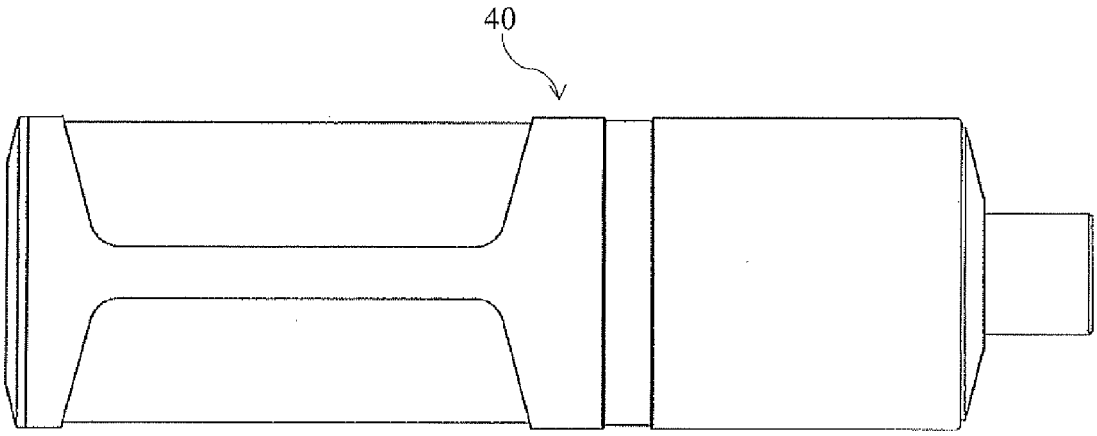

As shown in FIGS. 1, 2A, and 2B, a partition wall 68 in the insulating spacer 6 has an acoustic hole 7 such that a front air chamber 18 in the rear of the front fixed electrode 8 communicates with a rear air chamber 19 in the front of the rear fixed electrode 9. In the embodiment, the five acoustic holes 7 are symmetrically disposed centering on a front protrusion 61 and a rear protrusion 63 described below. The front protrusion 61 is disposed around the front center of the partition wall 68 in the insulating spacer 6 and projects forward while the rear protrusion 63 is disposed around the rear center of the partition wall 68 in the insulating spacer 6 and projects backward. The insulating spacer 6 needs reliable insulation and is thus composed of material having high surface resistivity and high volume resistivity.

A predetermined gap is provided between the front protrusion 61 and the rear surface of the front fixed electrode 8 and is filled with epoxy adhesive 62 as fixing material to fix the front protrusion 61 to the rear surface of the front fixed electrode 8. The fixing material is not limited to epoxy adhesive, and any adhesive can be preferably used which has high cured hardness.

If the unit is assembled with no gap between the front protrusion 61 and the rear surface of the front fixed electrode 8, the front fixed electrode 8 directly contacts with the insulating spacer 6 to apply stress to the center of the front fixed electrode 8, which stress deforms the front fixed electrode 8 such that it projects toward the front diaphragm 11. This changes the capacitance of a capacitor defined by the front fixed electrode 8 and the front diaphragm 11. A predetermined gap is thus provided between the front protrusion 61 and the rear surface of the front fixed electrode 8 while the front protrusion 61 is fixed to the rear surface of the front fixed electrode with the epoxy adhesive 62. This configuration effectively prevents a change in the capacitance of the capacitor due to the deformation of the front fixed electrode 8. The gap is preferably in the range of 0.1 to 0.3 mm.

In order to prevent the vibration, a large thickness of the insulating spacer 6 is preferred for ensuring satisfactory mechanical strength. As described above, the acoustic interterminal distance needs to be short in order to provide driving force for the front diaphragm 11 even in a high frequency range. Thus, the vibration must be prevented without an increase in the thickness of the insulating spacer 6.

The front fixed electrode 8 is generally composed of material having high mechanical strength such as a metal plate. The insulating spacer 6 is supported with the front fixed electrode 8 having high mechanical strength by fixing the front protrusion 61 to the rear surface of the front fixed electrode 8. This can effectively prevent vibration of the insulating spacer 6 by sound waves even at a lower thickness of the insulating spacer 6.

Similarly, a predetermined gap is provided between the rear protrusion 63 and the front surface of the rear fixed electrode 9 and is filled with epoxy adhesive 64 as fixing material to fix the rear protrusion 63 to the front surface of the rear fixed electrode 9. The predetermined gap is provided for the same as that of the front protrusion 61 and the front fixed electrode 8 and the duplicated description is thus omitted. This gap is also preferably in the range of 0.1 to 0.3 mm. The rear protrusion 63 is fixed to the front surface of the rear fixed electrode 9. This can further effectively prevent vibration of the insulating spacer 6 by sound waves even at a lower thickness of the insulating spacer 6.

Sound waves from the rear acoustic terminal 3 propagate through the rear acoustic resistance 4 and the acoustic hole 7 in the insulating spacer 6 to the front air chamber 18 in the rear of the front fixed electrode 8 and then urge the rear of the front diaphragm 11 to provide unidirectivity in the front diaphragm 11. The front air chamber 18 in the rear of the front fixed electrode 8 provides omnidirective driving force, and sound waves from the rear acoustic terminal 3 provide bidirective driving force. A bidirective driving force equal to the omnidirective driving force provides sound collection characteristics having cardioid unidirectivity. The principle of the unidirectivity in the rear diaphragm 12 is the same as that of the front diaphragm 11 except for the reversal geometrical configuration between the front and the rear of the relevant components and thus the duplicated description is omitted.

Figure 6:
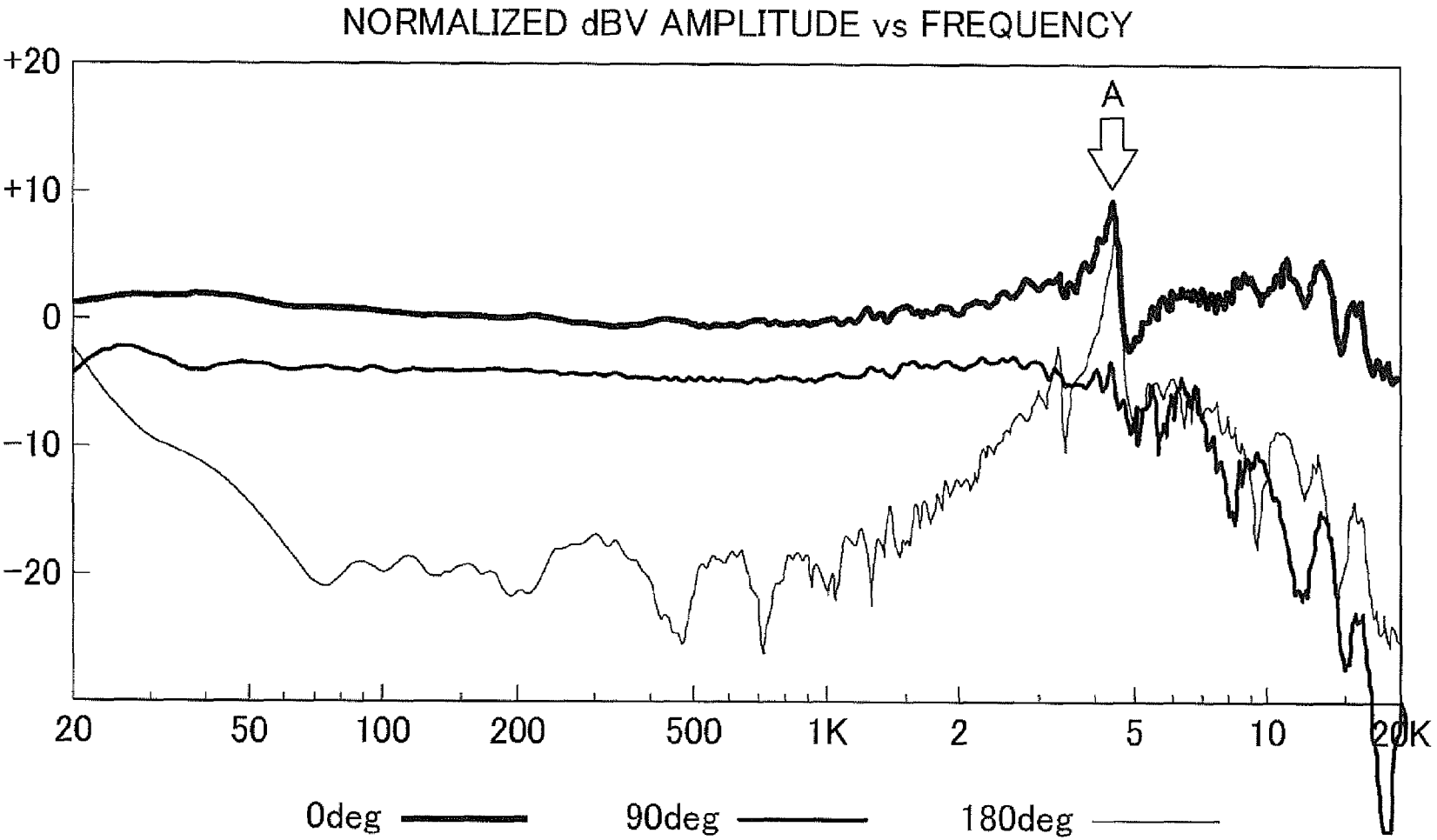
FIG. 6 is a graph illustrating the frequency response in the known unit.

The unidirective condenser microphone unit in accordance with the embodiment can reduce the acoustic interterminal distance and prevent the vibration of the insulating spacer caused by decreasing the thickness of the insulating spacer, which has not been achieved in a typical known unidirective condenser microphone unit. In the unidirective condenser microphone unit in accordance with the embodiment, the frequency response does not vary significantly as shown in FIG. 3, unlike the frequency range "A" in FIG. 6 in the typical known unidirective condenser microphone unit. The stable frequency response can effectively prevent, for example, low sound quality or howling caused in the typical known unit.

In the embodiment, the one front protrusion 61 and the one rear protrusion 63 are provided on the front surface and the rear surface, respectively, of the insulating spacer 6. The present invention is not limited to this configuration. The numbers of the front and rear protrusions may be more than one. In the embodiment, the front protrusion 61 and the rear protrusion 63 are provided substantially at the center of the front surface and the rear surface, respectively, of the insulating spacer 6. The present invention is however not limited to this arrangement. The front and rear protrusions may be provided in an area other than the center.

The condenser microphone unit in accordance with the embodiment can be applied to a condenser microphone to enable the condenser microphone to have advantageous effects of the condenser microphone unit.

What is claimed is:

1. A unidirective condenser microphone unit comprising:

a diaphragm;

a fixed electrode facing the diaphragm with a first gap and defining a capacitor together with the diaphragm;

an insulating spacer disposed adjacent to a first surface of the fixed electrode and supporting the fixed electrode;

an acoustic resistor disposcd in an air chamber defined by a second surface of the insulating spacer and the fixed electrode;

a unit case containing the diaphragm, the fixed electrode, the insulating spacer, and the acoustic resistor; and a front acoustic terminal and a rear acoustic terminal disposed in the unit case, wherein the insulating spacer has at least one protrusion projecting toward the fixed electrode with a second gap, and wherein the at least one protrusion is fixed to the first surface of the fixed electrode with fixing material.

2. The unidirective condenser microphone unit according to claim 1, wherein the at least one protrusion is fixed to a substantial center of the fixed electrode.

3. The unidirective condenser microphone unit according to claim 1, wherein the at least one protrusion is fixed to an area other than a center of the fixed electrode.

4. The unidirective condenser microphone unit according to claim 1, wherein the at least one protrusion comprises multiple protrusions.

5. The unidirective condenser microphone unit according to claim 2, wherein the at least one protrusion comprises multiple protrusions.

6. The unidirective condenser microphone unit according to claim 3, wherein the at least one protrusion comprises multiple protrusions.

7. The unidirective condenser microphone unit according to claim 1, wherein the fixing material comprises epoxy adhesive.

8. A unidirective condenser microphone comprising:

a unidirective condenser microphone unit comprising:

a diaphragm;

a fixed electrode facing the diaphragm with a first gap and defining a capacitor together with the diaphragm;

an insulating spacer disposed adjacent to a first surface of the fixed electrode and supporting the fixed electrode;

an acoustic resistor disposed in an air chamber defined by a second surface of the insulating spacer and the fixed electrode;

a unit case containing the diaphragm, the fixed electrode, the insulating spacer, and the acoustic resistor; and a front acoustic terminal and a rear acoustic terminal disposed in the unit case, wherein the insulating spacer has at least one protrusion projecting toward the fixed electrode with a second gap, and wherein at least the protrusion is fixed to the first surface of the fixed electrode with fixing material.

9. The unidirective condenser microphone according to claim 8, wherein the at least one protrusion is fixed to the substantial center of the fixed electrode.

10. The unidirective condenser microphone according to claim 8, wherein the at least one protrusion is fixed to an area other than the center of the fixed electrode.

11. The unidirective condenser microphone according to claim 8, wherein the at least one protrusion comprises multiple protrusions.

12. The unidirective condenser microphone according to claim 9, wherein the at least one protrusion comprises multiple protrusions.

13. The unidirective condenser microphone according to claim 10, wherein the at least one protrusion comprises multiple protrusions.

14. The unidirective condenser microphone unit according to claim 1, wherein the fixing material comprises an adhesive which has high cured hardness.

* * * * *